United States Patent [19]

Davis

[11] 4,008,847

[45] Feb. 22, 1977

[54] SHIPPING CONTAINER

[76] Inventor: John C. Davis, 1154 W. Mallard Drive, Palatine, Ill. 60067

[22] Filed: May 20, 1976

[21] Appl. No.: 688,383

[52] U.S. Cl. ..... 229/14 C; 206/45.14

[51] Int. Cl.[2] ..... B65D 5/50; B65D 5/44; B65D 25/14

[58] Field of Search ..... 229/14 C; 206/45.14, 206/45.19, 319, 320, 521

[56] References Cited

UNITED STATES PATENTS

| | | | |
|---|---|---|---|
| 2,008,664 | 7/1935 | Dowst | 206/45.19 |
| 2,426,865 | 9/1947 | Fink | 206/45.14 |
| 2,617,577 | 11/1952 | Tardiff | 206/45.14 X |
| 3,057,466 | 10/1962 | Blonder et al. | 206/45.19 |
| 3,093,290 | 6/1963 | Banks et al. | 206/45.14 X |
| 3,184,136 | 5/1965 | Forbes, Jr. | 229/14 C |
| 3,211,282 | 10/1965 | Hennessey | 229/14 C X |
| 3,481,453 | 12/1969 | Shreve et al. | 206/45.14 |
| 3,797,653 | 3/1974 | Goodsite | 229/14 C X |
| 3,871,520 | 3/1975 | Hand | 229/14 C X |

*Primary Examiner*—Davis T. Moorhead
*Attorney, Agent, or Firm*—Fitch, Even, Tabin & Luedeka

[57] ABSTRACT

A shipping container is disclosed for containing an article for shipment and for holding the article in relatively stable condition during shipment or storage. The container is made of one-piece fiberboard construction, and is generally formed from two pairs of opposed panels which are closed at the ends. To secure the article within the container, end flaps are also provided which may be folded into the container to cooperate with the article to hold it in a relatively stable position inside the container.

7 Claims, 4 Drawing Figures

SHIPPING CONTAINER

The present invention relates generally to fiberboard containers and more specifically to fiberboard containers utilizing inserts to stabilize and cushion the contents of the container from shock or vibration.

For adequate protection of articles which are shipped or stored in fiberboard containers, it is desirable to stabilize the articles against movement or shifting. Impact against the walls of the container may actually damage the product within the container or it may rupture the walls of the container, exposing the contents to other hazards such as dirt, rain or other weather conditions, theft or possible damage arising out of container handling procedures. Potential damage to product and container are particularly a problem when shipping wheel-mounted equipment or products, such as lawn mowers, which can easily roll into the container walls when subjected to shock or vibration.

In the past, a variety of reinforcements, packing materials and inserts have been used to cushion the contents of shipping containers and to prevent shifting or movement within the container, in accordance with Federal regulations which have been imposed. However, such reinforcements, inserts or packing have often required additional materials which are added to the container during or after the product has been inserted, such as Styrofoam packing, separate fiberboard inserts or the like. And depending on the size and shape of the product, the packing operation may be complicated and time consuming especially if several inserts, reinforcements or packings must be added before shipment. These additional materials and operations of course, result in an increased cost of packaging a product or article.

Accordingly, it is an object of the present invention to provide a shipping container which does not suffer the disadvantages of "prior art" containers.

Another object of the present invention is to provide a fiberboard container with inserts to secure the contents of the container against shifting or moving which may be relatively simply fabricated and assembled.

A further object of the present invention is to provide a fiberboard container which is easy to fabricate and assemble for shipping a lawn mower and which prevents the lawnmower from rolling or shifting inside the container.

The present invention meets these objects by providing a shipping container of one-piece fiberboard construction. The one-piece of fiberboard may be formed into two pairs of opposing panels which are joined to form a generally tubular compartment and closed at the ends to contain the article or contents. To restrict shifting or rolling of the contents, the unitary container also includes end flaps, portions of which are foldable into the container compartment and include means to engage the article enclosed, thereby substantially preventing shifting or rolling.

These and other objects and advantages of the present invention are more particularly set forth in the following detailed description and in the accompanying drawings of which:

Figure 1:
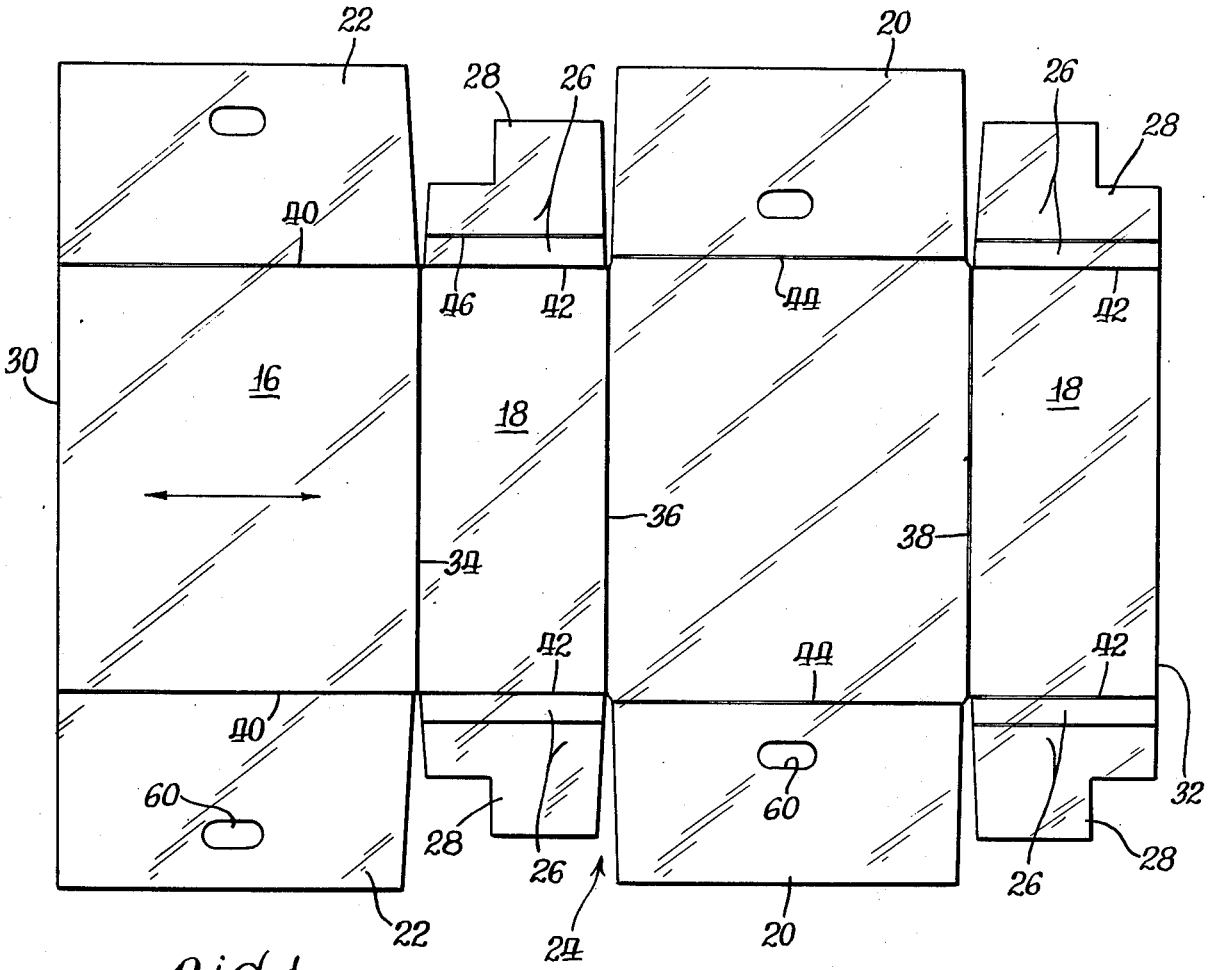
FIG. 1 is a plan view of the fiberboard blank used to form a container embodying the present invention.

The present invention is generally embodied in a fiberboard container 10 which may be used to hold articles 12, such as the lawnmowers illustrated, for shipment. The container includes a top wall 14, a bottom wall 16, a pair of opposed side-walls 18 extending therebetween to form a generally rectangular tubular chamber, closed at each end by a pair of end flaps 20 and 22, within which the article 12 resides.

In accordance with the present invention, a novel container is provided, which is easy to fabricate and assemble and which restrains the contents against shifting, by constructing the container 10 from a single piece of fiberboard 24 (best seen in FIG. 1) which includes side end flaps 26 which are foldable to form inserts 28 which extend into the container and include means to engage the article 12 to prevent shifting of the article within the container.

Figure 2:
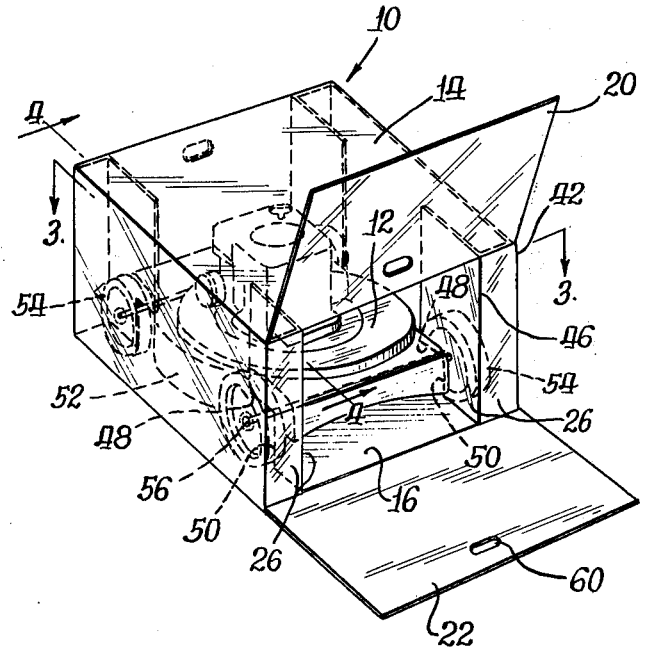
FIG. 2 is a perspective view of a container embodying the present invention with a lawnmower contained therein.
Figure 3:
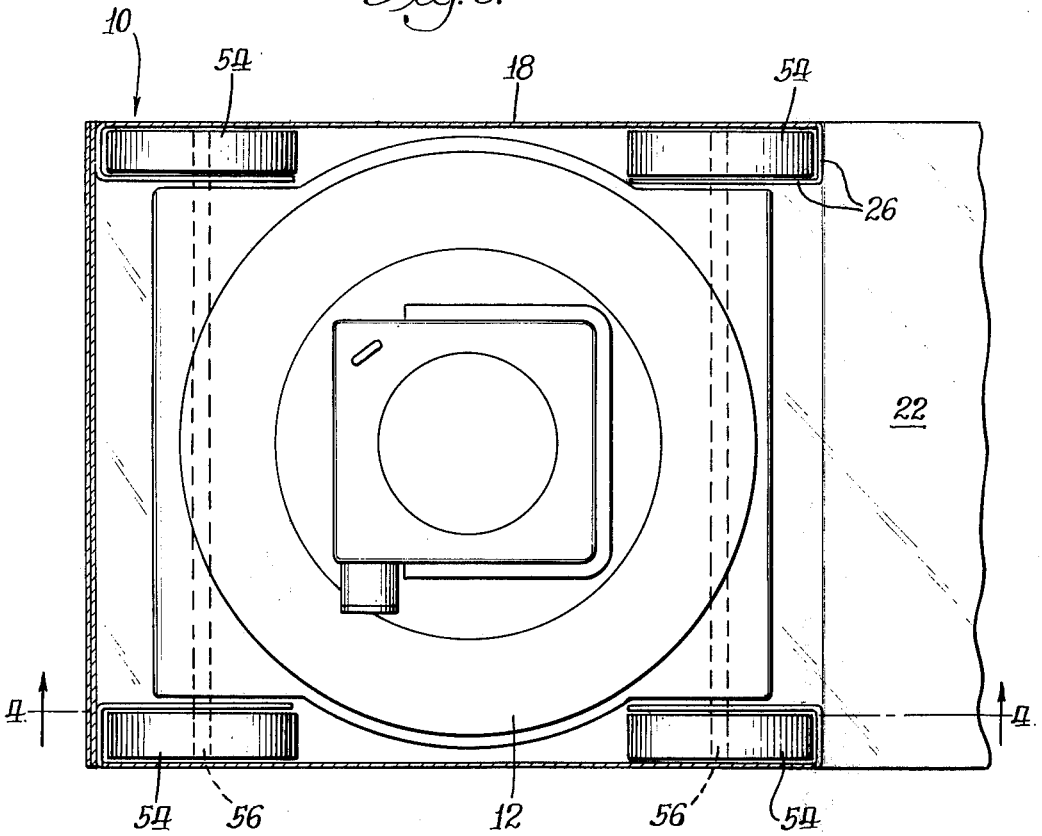
FIG. 3 is a horizontal sectional view taken along the line 3—3 of FIG. 2.

Turning now to a more detailed description of the drawings, which illustrate the preferred embodiment of the present invention, the container 10 (best seen in FIG. 2) is constructed from the single piece of fiberboard 24 (best seen in FIG. 1). The fiberboard panel or blank 24 may be made of any appropriate material but is preferably constructed of double-sheet, corrugated fiberboard, which is well-known in the paperboard manufacturing art and includes a corrugated panel sandwiched and bonded between two flat paper panels (not shown in detail). The strength required of the fiberboard may vary, depending on the particular application and the weight of the article, but for containing gasoline-powered lawnmowers, as illustrated in the drawings, the preferred test strength of the fiberboard is about 275 pounds per square foot, and the corrugations preferably run in the direction indicated by the arrow in FIG. 1, which is the direction of greatest resistance to compressive forces.

The top wall 14, bottom wall 16 and sidewalls 18 of the container 10 are generally rectangular and are formed from the single panel or blank of fiberboard 24 by lines of weakness, such as cut lines or score lines, or in any other manner well known in the corrugated box industry for dividing a blank into defined sections without completely severing adjoining sections. In order, from left edge 30 to right edge 32, the panel 24 is serially divided into the bottom wall 16, between the left edge 30 and a parallel line of weakness 34, one of the sidewalls 18 between the line of weakness 34 and a parallel line of weakness 36, the top wall 14 between the line of weakness 36 and a parallel line of weakness 38, and the other sidewall 18 between the line of weakness 38 and the right edge 32 which is parallel thereto.

The side end flaps 28 and top and bottom end flaps 20 and 22 are also formed from the single panel or blank 24. As more clearly seen in FIG. 1, the bottom end flaps 22 are foldably secured to opposite ends of the bottom wall 16 along lines of weakness 40 which are generally perpendicular to the left edge 30 and the line of weakness 34. The side end flaps 26 are foldably attached to each end of the sidewalls 18 by lines of weakness 42 which are similarly perpendicular to the lines of weakness 34, 36 and 38. And the top end flaps 20 are foldably secured to the ends of the top wall along lines of weakness 44 which are generally parallel to the lines of weakness attaching the other end flaps.

In practice, before the article 12 is loaded, the blank 24 is folded so that the end edges 30 and 32 meet and are joined by gluing, taping, stapling or the like, thereby forming the blank into a generally rectangular tube defined by the top wall 14, bottom wall 16 and sidewalls 18 which has open fore and aft ends ready for end loading the article 12. This construction, however, also allows the container to actually be wrapped around the article 12 if desired. This may be done by first placing the article 12 on the bottom panel 16 and then wrapping the panel 24 over the article and joining the ends 30 and 32 to form the tubular configuration of the top, bottom and sidewalls. In either case, of course, the length and width of the single panel or blank 24 would vary, depending on the size of the article 12 to be enclosed.

To hold the article 12 in relatively stable position inside the container 10 the end flaps 26 are foldable along a fold line 46 to extend into the tubular configuration described above to engage the article 12 and prevent rolling or shifting. The fold line 46 is preferably spaced from the line of weakness 42 which connects the side end flap to the sidewall and is generally parallel thereto to divide each end flap into the insert portion 28 which extends directly into the tubular configuration to abut the article 12. In the preferred embodiment, each side end flap is folded inwardly at the line of weakness 42 to form approximately a right angle with the sidewall 18. And the insert portion 28 of the end flap 26 is folded along the fold line 46 through approximately 90° relative to the rest of the side end flap to extend into the container, approximately parallel to the sidewall 18. Each side end flap 26 is of approximately the same height as the sidewall 18 and the insert portion 28 of the side end flap according substantially extends completely between the inside surface of the bottom wall to the inside surface of the top wall.

Figure 4:
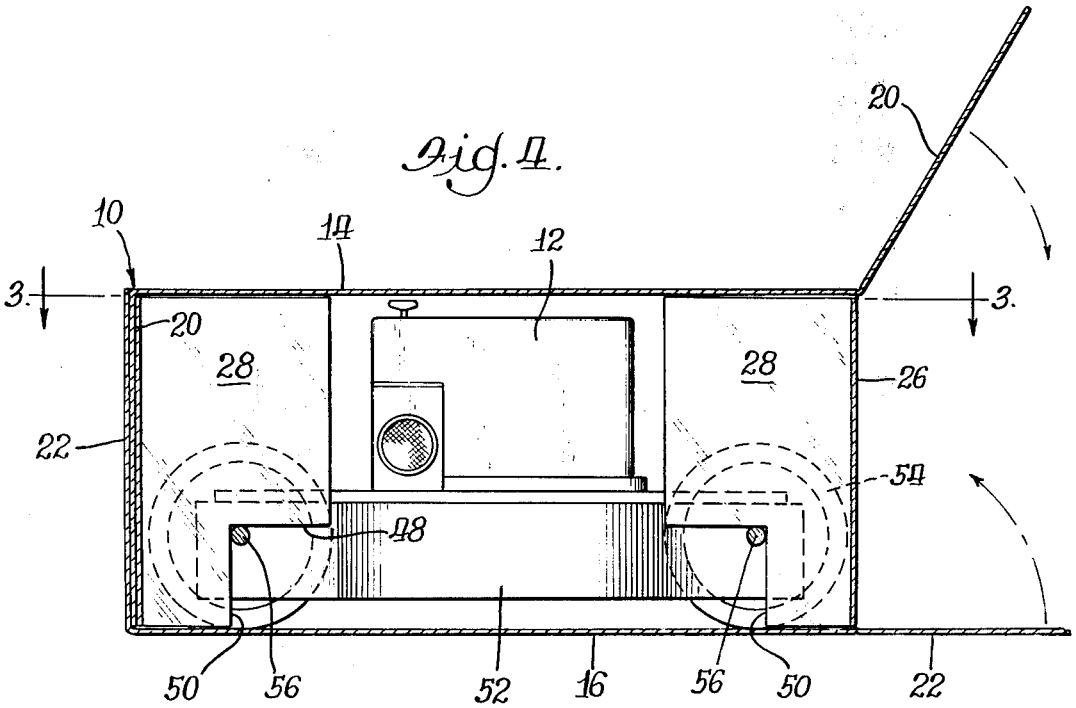
FIG. 4 is a vertical sectional view taken along the line 4—4 of FIG. 3.

To actually engage the article 12 to secure it against shifting, each insert portion 28 is shaped to abut a portion of the article. The particular shape needed depends on the nature of the article contained, and in the illustrated embodiment, the article is a rotary lawnmower with its wheels generally aligned with the open fore and aft ends of the tubular compartment. For holding and containing the rotary lawnmower against rolling between the ends of the compartment, a right-angled recess (best seen in FIG. 4) is defined by edges 48 and 50 in the lower corner of each insert for positioning of the insert between a frame member 52 of the mower and one of the wheels 54 which is attached to the frame by an axle 56. The insert portion 28 is of sufficient length to extend beyond the axle 56 of the lawnmower and is preferably dimensioned, according to the size of the particular lawnmower, so that the axle 56 is nested into corner of the recess in the insert (best seen in FIG. 4), the edge 48 abutting the top of the axle, and the edge 50 abutting the side of the axle, thereby trapping the axle to provide a hold-down for the mower and to prevent the lawnmower from rolling or shifting toward the ends of the container. Although the drawings illustrate a container having an insert portion 28 over each of four wheels of a lawnmower which is centrally positioned within the container, this is the preferred embodiment and fewer inserts or inserts of different dimensions may be needed depending on the size and weight of the lawnmower, or other article, and the positioning within the container. For example, if the lawnmower is allowed to abut one end of the container, only one or two inserts may be needed at the other end to prevent the mower from rolling in the container. And the lawnmower may also be prevented from rolling, although perhaps less positively than in the nesting arrangement, by providing the insert to only abut the side of the axle 56 without also engaging the top of the axle.

After the lawnmower has been inserted into the container, the side end flaps 26 are folded into position, the portion between the line of weakness 42 and the fold line 46 extending perpendicularly from the sidewall 18 to maintain the corner strength of the container and to provide a fastening surface for the top and bottom end flaps 20 and 22, and the insert portion 28 is folded along the fold line 46 to extend into the container parallel to the side 18 to abut the article 12. In the illustrated embodiment, the insert portion 28 is recessed to slide over the axle 56 of the lawnmower between the frame and the wheel but if the axle is inaccessible, e.g., because of a height adjustment mechanism between the frame and the wheel, the insert portion may be cut or recessed to abut some part of the lawnmower frame or wheel.

After the side end flaps have been secured in place, the ends of the tubular compartment are closed by the generally rectangular top and bottom end flaps, which are appropriately sized to fully cover each end, by folding the top end flaps 20 downwardly and the bottom end flaps 22 upwardly and securing them in place as by gluing or stapling. The portion of the side end flap between the line of weakness 42 and the fold line 46 provides an abutment surface against which the top and bottom end flaps may be folded and secured. Although this is the preferred method, other closure means, such as separate end caps may also be used to close each end of the container. And to aid in handling the filled container, hand holds 60 are provided in the top and bottom end flaps 20 and 22 of the container 10 for lifting and carrying.

When a series of containers are stacked atop one another, which is likely to occur in storage, the direction of the corrugations described earlier cooperates with the novel construction to give increased stacking strength to the container. As noted above, the corrugation of the fiberboard panel 24 runs in the direction of the large arrow in FIG. 1. When the panel is folded into the container configuration shown in FIG. 2 this results in the corrugations running vertically, the direction of greatest columnar strength and compression resistance, in the side end flaps 26 and in the top and bottom end flaps 20 and 22 when they are folded to the closed position. The portion of the side end panel between the line of weakness 42 and the fold line 46 is perpendicular to the sidewall 18 to maintain the corner stacking strength of the container, the vertical corrugations further contribute to this construction by giving that portion of the side flap additional stacking strength. The vertical corrugations also add to the stacking strength contributed by the top and bottom end flaps and the insert portion of the flap 26 which extends between the top and bottom walls 20 and 22 of the container.

It may therefore be seen that the present invention provides a novel one-piece container which may be used to ship articles, especially lawnmowers, protected against rolling or shifting within the container, but which container is easy to fabricate and simple to utilize without additional packaging materials or complicated assembly techniques. Although the present invention has been described in terms of the preferred embodiment, various modifications, some immediately apparent, and others apparent only after some study, may be made without departing from the present invention. For example, rather than right-angle recess in the insert portion 44, the insert may only be slotted to receive the axle of the lawnmower, even though this probably would require a more tedious assembly operation. Or the insert portion might be carried on the top or bottom end flaps rather than the side and flaps.

Various of the features of the invention are set forth in the following claims.

What is claimed is:

1. A one-piece fiberboard container for containing a lawnmower having a frame with four wheels, each carried on an axle substantially at four corners of said frame, said container comprising a top wall, a bottom wall and a pair of opposed sidewalls extending between and joining said top and bottom walls to form a generally tubular compartment with open fore and aft ends for containing said lawnmower in-line with said ends, side end flaps foldably attached to each end of said side walls, each of said side end flaps having an insert portion and an intermediate portion between said insert portion and the side wall to which it is attached, said intermediate portion being disposable at substantially right angles to said sidewall at the end of said container, said insert portion being foldable to extend into said tubular compartment for positioning between said frame and one of said wheels, said insert portion including a right-angled recess to nest against the axle of the lawnmower container therein, and closure flaps foldably secured to said top and bottom walls to close the fore and aft ends of said tubular compartment over said side end flaps, and substantially perpendicular to said insert portions, each of said closure flaps further extending substantially between said top and bottom walls.

2. A one-piece fiberboard container for containing a lawnmower having a frame with four wheels carried at locations spaced around said frame, said container comprising a top wall, a bottom wall and a pair of opposed side walls extending between said top and bottom walls to form a generally tubular compartment with fore and aft ends for containing said lawnmower in-line with said ends, said container having at least one side end flap carried on one end of selected of said side walls and extending substantially between said top and bottom walls, said side end flap including a terminal insert portion and an intermediate portion between said terminal insert portion and said selected side wall, said intermediate portion being foldable substantially perpendicular to said side wall, said terminal insert portion being attached at one end to said intermediate portion and foldable to extend into said tubular compartment, said insert portion terminating at a free end which is free of said selected wall for insertion between one of said wheels and said frame, and means on said insert portion for engaging the lawnmower to restrict shifting or rolling within said tubular compartment.

3. A container in accordance with claim 2 in which said means on said insert portion for engaging said lawnmower is said free edge of said insert portion, which abuts said lawnmower.

4. A container in accordance with claim 3 which further comprises closure flap means on other of said top, bottom or side walls for closing said tubular compartment over said end flap substantially perpendicular to said terminal insert portion to provide a backstop for compressive forces exerted against said insert portion.

5. A container in accordance with claim 4 in which said closure flap means includes at least one closure flap at each end of said container, said closure flap being carried on said top or bottom wall and extending substantially between said top and bottom walls to improve the container stacking strength.

6. A one-piece fiberboard container for containing a lawnmower having a frame with four wheels carried at spaced locations around said frame, said container comprising a top wall, a bottom wall and a pair of opposed side walls extending between said top and bottom walls to form a generally tubular compartment with fore and aft ends for containing said lawnmower in-line with said ends, a side end flap foldably attached to each end of said side walls, each side end flap extending substantially between said top and bottom walls and having a generally planar terminal insert portion and a planar intermediate portion between said insert portion and the side wall to which said side end flap is attached, said intermediate portion being foldable to a position substantially perpendicular to said side wall, said terminal insert portion being attached at one end to said intermediate portion and foldable at said attachment to extend into said tubular compartment and terminating therein, said insert portion being spaced from said side wall to which it is attached and extending generally parallel thereto for insertion between the lawnmower frame and one of the wheels, said terminating end of said insert portion engaging said lawnmower to restrict rolling or shifting, and a closure flap foldably secured at each end of said top and bottom walls to close said fore and aft ends of said tubular compartment over said side end flaps substantially perpendicular to said insert portions to provide a backstop against compressive forces exerted against said insert portion, and each of said closure flaps extending substantially between said top and bottom walls to reinforce stacking strength.

7. A container in accordance with claim 6 in which the wheels of said lawnmower are carried on said frame by axle means and a recessed shoulder on said terminating end is provided in each terminal insert portion to permit said terminal insert portion to extend over and to engage said axle means.

* * * * *